US008387966B2

(12) United States Patent
Dinnissen

(10) Patent No.: US 8,387,966 B2
(45) Date of Patent: Mar. 5, 2013

(54) SHEET PROCESSING APPARATUS

(75) Inventor: Johannes H. A. Dinnissen, Venlo (NL)

(73) Assignee: OCE Technologies B.V., Venlo (NL)

( * ) Notice: Subject to any disclaimer, the term of this patent is extended or adjusted under 35 U.S.C. 154(b) by 0 days.

(21) Appl. No.: 13/443,649

(22) Filed: Apr. 10, 2012

(65) Prior Publication Data

US 2012/0205854 A1 Aug. 16, 2012

Related U.S. Application Data

(63) Continuation of application No. PCT/EP2010/065179, filed on Oct. 11, 2010.

(30) Foreign Application Priority Data

Oct. 23, 2009 (EP) ..... 09173885

(51) Int. Cl.
*B65H 37/04* (2006.01)

(52) U.S. Cl. ..... 270/58.11; 414/791.2

(58) Field of Classification Search ..... 414/791.2; 270/58.11, 58.17
See application file for complete search history.

(56) References Cited

U.S. PATENT DOCUMENTS

| | | | | |
|---|---|---|---|---|
| 6,047,960 | A * | 4/2000 | Kawano et al. | 271/184 |
| 6,231,039 | B1 * | 5/2001 | Chung | 270/58.01 |
| 6,371,472 | B1 * | 4/2002 | Miyake et al. | 270/58.14 |
| 6,394,442 | B1 * | 5/2002 | Antinora et al. | 270/58.11 |
| 6,819,906 | B1 * | 11/2004 | Herrmann et al. | 399/368 |
| 2002/0079640 | A1 | 6/2002 | Yoshie et al. | |
| 2003/0052446 | A1 | 3/2003 | Endo et al. | |
| 2008/0187383 | A1 | 8/2008 | Yamamoto | |

* cited by examiner

*Primary Examiner* — Patrick Mackey
(74) *Attorney, Agent, or Firm* — Birch, Stewart, Kolasch & Birch, LLP

(57) ABSTRACT

A sheet processing apparatus includes a laterally moveable post-processing module moveable from a predetermined operating position to a predetermined lateral delivery position and a control unit. The control unit is configured to operate the post-processing module such that a lateral delivery position for a set of at least one sheet is determined, the post-processing module is moved to the operating position, the post-processing module is operable to subsequently engage the set of at least one sheet to obtain a processed set of at least one sheet, then move the post-processing module from the operating position to the delivery position in coupling engagement with the processed set of at least one sheet, to move the processed set of at least one sheet to the lateral delivery position and disengage the post-processing module to deliver the processed set of at least one sheet at the lateral delivery position.

12 Claims, 5 Drawing Sheets

SHEET PROCESSING APPARATUS

CROSS-REFERENCE TO RELATED APPLICATIONS

This application is a Continuation of International Application No. PCT/EP2010/065179, filed on Oct. 11, 2010, and for which priority is claimed under 35 U.S.C. §120, and which claims priority under 35 U.S.C. §119 to Application No. 09173885.6, filed on Oct. 23, 2009. The entirety of each of the above-identified applications is expressly incorporated herein by reference.

BACKGROUND OF THE INVENTION

1. Field of the Invention

The present invention relates to a sheet processing apparatus for processing a set of at least one sheet comprising a laterally moveable post-processing module. The invention also pertains to a method for processing a set of at least one sheet in a sheet processing apparatus and to a printing system comprising such sheet processing apparatus.

2. Background of the Invention

Sheet processing apparatus for processing a set of at least one sheet comprising a laterally moveable post-processing module are known. In this kind of sheet processing apparatus, a sheet is fed in a process direction through a transport path along which one or more processing and/or post-processing modules operate on the sheet. To introduce more flexibility in the possibilities of such post-processing modules, it is known to configure a post-processing module in a laterally moveable way, such that the post-processing module is moveable in a lateral direction, i.e. perpendicular to the process direction, such that the post-processing module is operable on a plurality of locations on the sheet. After the one or more post-processing operations on the sheet, the sheet is usually delivered to a next sheet processing apparatus or to a delivery location, where an operator may take out the sheet or processed set of at least one sheet. It is a disadvantage of this type of sheet processing apparatus that the operator is not able to discriminate between the individual sheets or sets of sheets at the delivery location.

SUMMARY OF THE INVENTION

It is an object of the present invention to provide for a sheet processing apparatus, which enables an operator to easily discriminate between the sequential sheets or sets of sheets.

To this end, a method for processing a set of at least one sheet according to the present invention comprises the steps of: determining a lateral delivery position for the set of at least one sheet; moving a post-processing module to an operating position such that the post-processing module is able to operate at a predetermined position on the set of at least one sheet; and operating the post-processing module to subsequently: engage the set of at least one sheet to process the set of at least one sheet into a processed set of at least one sheet; move the post-processing module from the operating position to the lateral delivery position in coupling engagement with the processed set of at least one sheet, such that the processed set of at least one sheet is moved to the lateral delivery position; and disengage the post-processing module to deliver the processed set of at least one sheet at the lateral delivery position.

The method comprises operating a laterally moveable post-processing module such that the post-processing module operates at a position at which the post-processing action is performed on a set of at least one sheet and subsequently moves the post-processing module from that position to a different lateral position in coupling engagement with the set of at least one sheet, such that the set of at least one sheet is moved to the different lateral position before the coupling engagement is disengaged. Using the post-processing module to shift the lateral position of the set of at least one sheet in a sheet processing apparatus may result in a shift in the position of that set of at least one sheet at a delivery location downstream of the sheet processing apparatus. This enables an operator to easily discriminate between subsequent sets of at least one sheet.

The lateral direction is a direction perpendicular to the direction in which sheets are transported through the apparatus. A lateral movement is a movement in the lateral direction. A coupling engagement between the post-processing module and the set of at least one sheet is an engagement that results in a movement of the set of at least one sheet as a result of a movement of the post-processing module. A post-processing module is a module configured to perform a post-processing action on a set of at least one sheet. Post-processing incorporates any processing step downstream of the image-forming process.

In an embodiment of the method according to the present invention, the coupling engagement comprises a clamping engagement, such that the post-processing module engages with the set of at least one sheet by means of applying a clamping force. This clamping force may, e.g. result from an additional clamping device on the post-processing module or from the post-processing operation itself. The clamping is preferably large enough to overcome resistance forces such as, e.g. friction, which is imposed upon the set of at least one sheet when moved in a lateral direction, but not too large, as this may result in damaging the set of at least one sheet. A clamping engagement may, e.g. be implemented by moving a first clamping element located at a first side of the set of at least one sheet towards a second clamping element located at an opposing second side of the set of at least one sheet. Such clamping elements may be a dedicated clamping device configured to clamp, such as, e.g. friction elements or a device that is used for other purposes, such as the post-processing operation of the post-processing module.

In another embodiment, the coupling engagement comprises an at least partially protruding engagement, such that the post-processing module engages with the set of at least one sheet by means of applying an at least partially protruding engagement. An at least partially protruding engagement may be induced, e.g. by protrusion elements that protrude the set of at least one sheet at least partially when imposing the lateral movement upon the set of at least one sheet. These protrusion elements may come from either side of the set of at least one sheet and may protrude the set of at least one sheet completely, such that the protrusion elements penetrate the set of at least one sheet such that the engagement is imposed mechanically. The set of at least one sheet moves along with the post-processing module when the protruding elements move laterally. Alternatively, the protrusion may be partially through the set of at least one sheet such that the engagement is imposed both by friction as well as mechanically. The at least partially protruding engagement may be imposed as part of the post-processing operation itself or imposed separately from the post-processing operation.

In another embodiment, processing the set of at least one sheet comprises stapling the set of at least one sheet. A stapling operation commonly involves a motion of the post-processing module towards the set of at least one sheet. If the stapling post-processing module, such as a stapler unit, is suitably controlled, the method according to the present invention enables the module to laterally shift the set of at least one sheet with respect to preceding and/or subsequent sets of at least one sheet, such that the operator can easily discriminate between these sets at the delivery station of a system with such a sheet processing module. The stapling operation may induce a coupling engagement itself or may, e.g. clamp the set of at least one sheet before or after the stapling operation, by means of the stapling device or a dedicated additional clamping device, which may be tuned for optimal gripping pressure to overcome resisting forces while not damaging the set of at least one sheet.

In another embodiment, processing the set of at least one sheet comprises applying at least one hole through the set of at least one sheet. Applying a hole through a sheet of a set of sheets may include, e.g. perforating, drilling, punching or any other hole imposing operation. The number of holes in the set of at least one sheet may vary dependent on the desired application of the set of at least one sheet. The number may be preconfigured per sheet processing module or be configured to controllably vary.

The coupling engagement may be imposed, e.g. by operating a certain punch, engaging the punch to move through the set of at least one sheet, thereby forming holes in accordance with the punch used and then holding the punch in the engaged position, laterally moving the punch along with the post-processing module and subsequently disengaging the punch, thereby leaving the set of at least one sheet at the lateral delivery position.

In another embodiment, processing the set of at least one sheet comprises binding the set of at least one sheet. Binding a set of at least one sheet may include, e.g. gluing, perfect binding, sewing, spiral binding or any other sheet binding operation.

The coupling engagement may be imposed, e.g. by imposing a frictional force to the set of at least one sheet after binding to press the sheets in the set together. This pressing together may then be continued during the lateral movement of the binding unit, thereby moving the set of at least one sheet along with the binding unit in a grippingly coupling engagement.

In another aspect, the present invention relates to a sheet processing apparatus for processing a set of at least one sheet configured to perform the above method. Such a sheet processing apparatus may be, e.g. a sheet finishing apparatus, an image-forming system such as a digital printer, a facsimile machine or the like, or be implemented as a separate module suitable for implementation as a modular unit in a sheet-processing system.

In an embodiment, the sheet processing apparatus comprises a laterally moveable post-processing module moveable from a predetermined operating position to a predetermined lateral delivery position and a control unit for controlling the post-processing module, wherein the control unit is configured to operate the post-processing module such that a lateral delivery position for the set of at least one sheet is determined; the post-processing module is moved to the operating position; and the post-processing module is operable to subsequently: engage the set of at least on sheet to process the set of at least one sheet into a processed set of at least one sheet; move the post-processing module from the operating position to the delivery position in coupling engagement with the processed set of at least one sheet, such that the processed set of at least one sheet is moved to the lateral delivery position; and disengage the post-processing module to deliver the processed set of at least one sheet at the lateral delivery position.

The predetermined operating position is the position of the post-processing module in which it is operable to perform its post-processing operation on the set of at least one sheet. The predetermined lateral delivery position is the position of the post-processing module in which it is able to disengage the set of at least one sheet such that the set of at least one sheet is delivered in the required lateral position at a delivery station. The determination of the operating position and/or the lateral delivery position may be statically preconfigured per sheet processing apparatus, e.g. by mechanical configuration, or dynamically determined, e.g. per sheet, per time-unit or per set of sheets. Dynamically determining these positions may be implemented by means of, e.g. reading out of an electronic memory, actively controlled by any sensing device.

It will be clear to the skilled person that the lateral movement of the post-processing module may be a translation, a rotation or any other combination of movements.

The control unit of the sheet processing apparatus may be a single physical unit or a distributed collection of elements throughout the sheet processing apparatus, and may even depend on interactions with control elements outside the sheet processing apparatus.

In another embodiment, the sheet processing apparatus is configured to engage with the set of at least one sheet by clamping the set of at least one sheet, such that the post-processing module engages with the set of at least one sheet by means of applying a clamping force. This clamping force may, e.g. result from an additional clamping device on the post-processing module or from the post-processing operation itself. The clamping is preferably large enough to overcome resistance forces such as, e.g. friction which is imposed upon the set of at least one sheet when moved in a lateral direction, but not too large, as this may result in damaging the set of at least one sheet. A clamping engagement may, e.g. be implemented by moving a first clamping element located at a first side of the set of at least one sheet towards a second clamping element located at an opposing second side of the set of at least one sheet. Such clamping elements may be dedicated devices configured to clamp, such as, e.g. friction elements or be devices that are used for other purposes, such as the post-processing operation of the post-processing module.

In another embodiment, the sheet processing apparatus is configured to engage with the set of at least one sheet by at least partially protruding the set of at least one sheet, such that the post-processing module engages with the set of at least one sheet by means of applying an at least partially protruding engagement. An at least partially protruding engagement may be induced, e.g. by protrusion elements that protrude the set of at least one sheet at least partially when imposing the lateral movement upon the set of at least one sheet. These protrusion elements may come from either side of the set of at least one sheet and may protrude the set of at least one sheet completely, such that the protrusion elements penetrate the set of at least one sheet such that the engagement is imposed mechanically. The set of at least one sheet moves along with the post-processing module when the protruding elements move laterally. Alternatively, the protrusion may be partially through the set of at least one sheet such that the engagement is imposed both by friction as well as mechanically. The at least partially protruding engagement may be imposed as part of the post-processing operation itself or imposed separately from the post-processing operation.

In another embodiment, the post-processing module comprises a stapler unit for stapling the set of at least one sheet. A stapling operation commonly involves a motion of the post-processing module towards the set of at least one sheet. If the stapling post-processing module, such as a stapler unit, is suitably controlled, the sheet processing apparatus enables the module to laterally shift the set of at least one sheet with respect to preceding and/or subsequent sets of at least one sheet, such that the operator can easily discriminate between these sets at the delivery station of a system with such a sheet processing module. The stapling operation may induce a coupling engagement itself or may, e.g. clamp the set of at least one sheet before or after the stapling operation, by means of the stapling device or a dedicated additional clamping device, which may be tuned for optimal gripping pressure to overcome resisting forces while not damaging the set of at least one sheet.

In another embodiment, the post-processing module comprises a device configured to apply at least one hole through the set of at least one sheet. Applying a hole through a sheet of a set of sheets may include, e.g. perforating, drilling, punching or any other hole imposing operation. The number of holes in the set of at least one sheet may vary dependent on the desired application of the set of at least one sheet. The number may be preconfigured per sheet processing module or be configured to controllably vary.

The coupling engagement may be imposed, e.g. by operating a certain punch, engaging the punch to move through the set of at least one sheet, thereby forming holes in accordance with the punch used and then holding the punch in the engaged position, laterally moving the punch along with the post-processing module and subsequently disengaging the punch, thereby leaving the set of at least one sheet at the lateral delivery position.

In another embodiment, the post-processing module comprises binding the set of at least one sheet. Binding a set of at least one sheet may include, e.g. gluing, perfect binding, sewing, spiral binding or any other sheet binding operation.

The coupling engagement may be imposed, e.g. by operating frictional force applied to the set of at least one sheet after binding to press the sheets in the set together. This pressing together may then be continued during the lateral movement of the binding unit, thereby moving the set of at least one sheet along with the binding unit in a grippingly coupling engagement.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
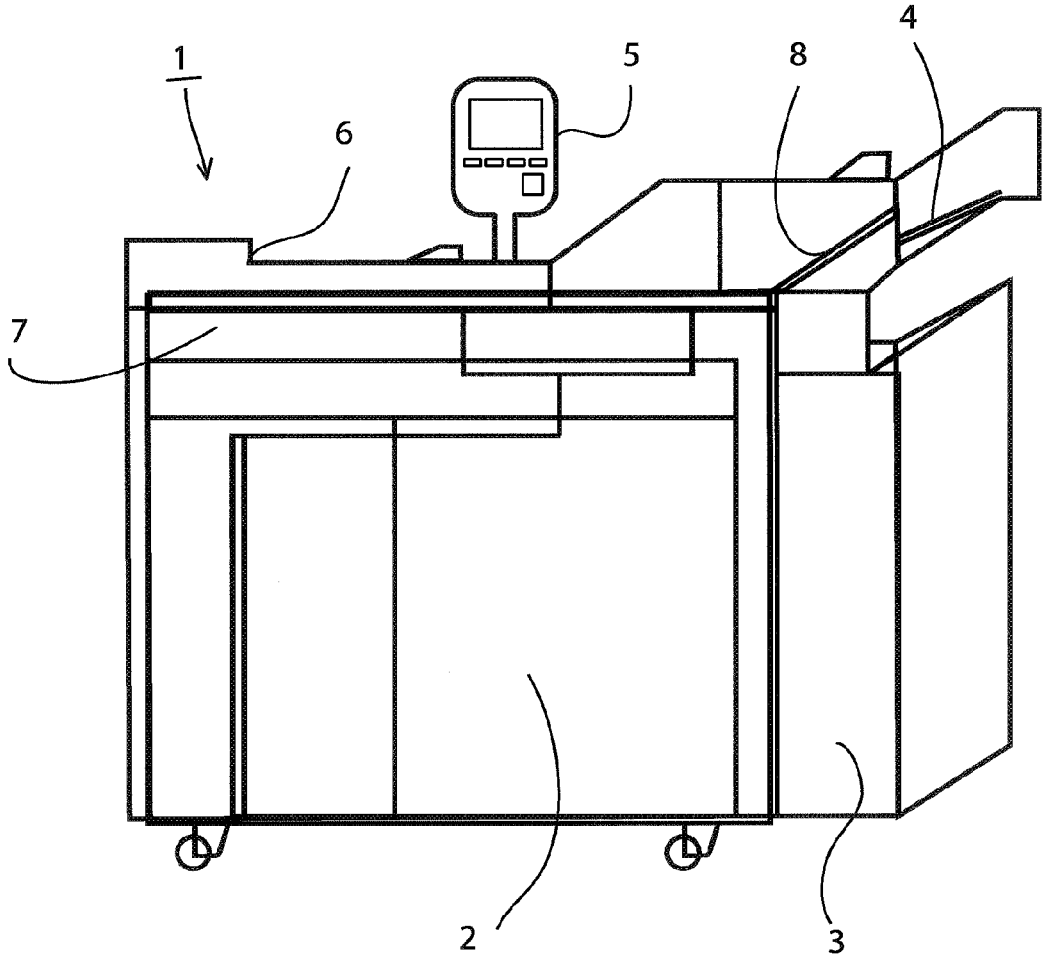
FIG. 1 is a schematic view showing a printing system comprising a sheet processing apparatus.

FIG. 1 is a schematic view illustrating a printing system comprising a sheet processing apparatus according to an embodiment of the present invention. The printing system 1 has an engine 2 in which the paper is fed into from a supply 3, preconditioned and printed with a printing process 50 and fed to a take-out area from which an operator can take-out the printed media. The printing system 1 delivers marking material onto the print media in an image-wise fashion. The image can be fed, e.g. by a computer via a wired or wireless network connection (not shown) or by means of a scanner 7. The scanner 7 scans an image that is fed into the automatic document feeder 6 and delivers the digitized image to the printing controller (not shown). The controller translates the digital image information into control signals that enable the controller to control the marking units that deliver marking material onto an intermediate member. A preheated print medium is fed along the intermediate member, from which the image-wise marking material image is transferred onto the print medium. The marking material image is fused on the print medium in a fuse step under elevated pressure and temperature. The image bearing print medium is cooled down to a lower temperature before the print medium is delivered to the take-out area 4. A user-interface 5 enables the operator to program the print job properties and preferences such as the choice for the print medium, print medium orientation and finishing options. The user-interface may alternatively be configured as a single unit as depicted in FIG. 1, or alternatively be configured as a distributed set of units positioned on or separated from the printing system. The printing system 1 has a plurality of finishing options such as stacking, saddle stitching, gluing, punching, perfect binding and stapling. The finishing unit 8 executes these finishing operations when selected. It will be clear for the person skilled in the art that other image forming processes, wherein an image of marking material is transferred onto a print media, possibly via one or more intermediate members, e.g. electro(photo)graphic, magnetographic, inkjet, and direct imaging processes are also applicable. It will be clear for the person skilled in the art, that the finishing options may be integrated in a single unit, or alternatively be distributed over several units, which may be, e.g. connected to each other in serial, such that a print medium is able to be transported from the engine to the designated post-processing or output location(s).

Figure 2A:
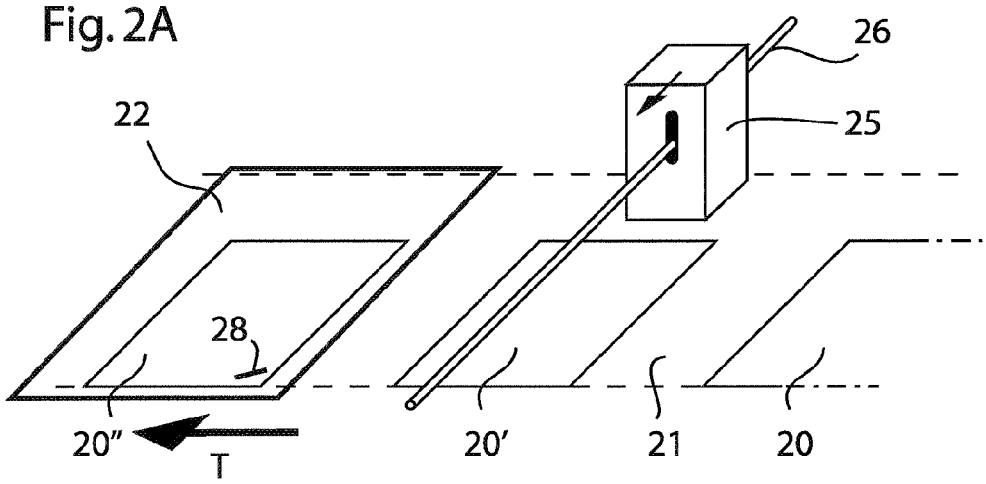
FIGS. 2A-2F are schematic views illustrating the operation of a sheet processing device according to the present invention, comprising a post-processing module.
Figure 2B:
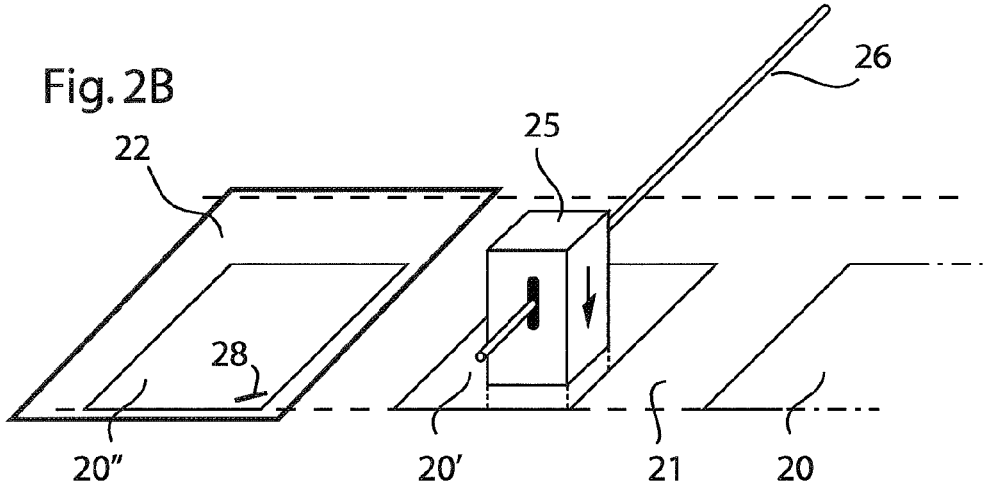

FIGS. 2A-2F are schematic views illustrating the operation of a sheet processing device according to the present invention, comprising a post-processing module, in particular a stapling unit 25. In FIG. 2A, stapling unit 25 is mounted along a sheet transport path 21. The sheet transport path 21 is configured to transport a single sheet of print medium, or a stack 20 of print media. Stack 20 is formed by collecting subsequent print media along the sheet transport path 21. The formed stack 20 of print media is transported from a print engine in transport direction indicated by arrow T, towards a delivery location 22 where an operator may take the processed sheet or stack of sheets. Stapling unit 25 is mounted on guide element 26 on which the stapling unit 25 is able to be controllably moved laterally over the sheet transport path 21. Alternatively, this movement may be (partially) rotational in lateral direction, but has a net direction in a lateral direction with respect to the sheet transport path 21. The sheet transport path 21 comprises three stacks of print media; Stack 20 which is at the collecting location, in which separate sheets are collected onto stacks, stack 20' which is at the post-processing location, in which a post-processing operation is executed on the stack 20' of print media and stack 20" which is at the delivery location, in which an operator may take away one or more stacks 20" for further use thereof. Stack 20" is placed at the delivery position 22 and comprises a left top corner staple 28. In FIG. 2A the stapling unit 25 is controlled from its home position towards a processing position, which is illustrated in FIG. 2B. During the controlled movement of stapling unit 25, the unit is controlled to maintain the level of its bottom to be higher than the level in which the top of stack 20' is positioned, such that the stack 20' is not disturbed.

FIG. 2B illustrates the post-processing operation on stack 20' by stapling unit 25. The stapling unit is controlled to a position over the stack 20' such that the stapling unit is able to perform a stapling operation at the required position on the stack 20'. To operate the stapling unit 25, the stapling unit 25 is controlled to move downward towards the stack 20'. In this embodiment, an anvil (not shown) is laterally located along the sheet transport path 21 under the stapling unit 25 to complete the stapling operation. In an alternative non-shown embodiment the anvil is moveably mounted and controlled towards the top stapler unit during a stapling operation.

Figure 2C:
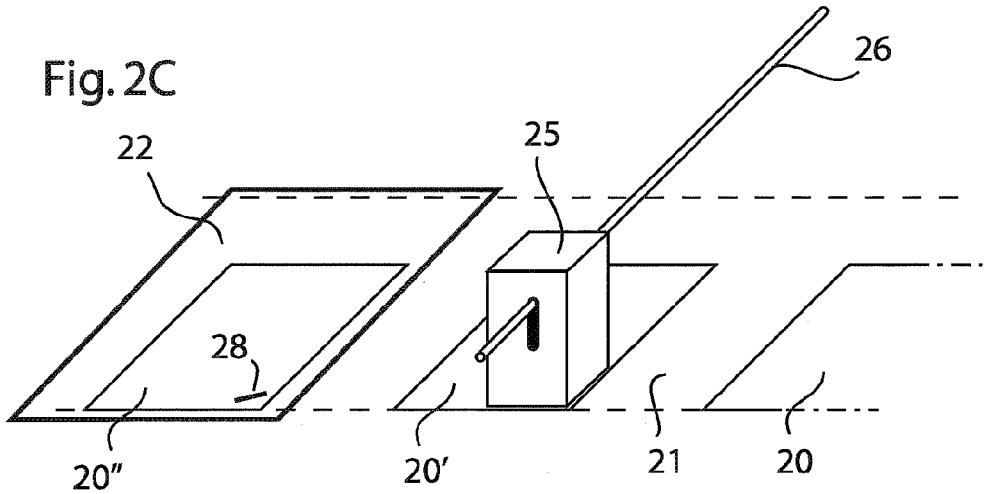
Figure 2D:
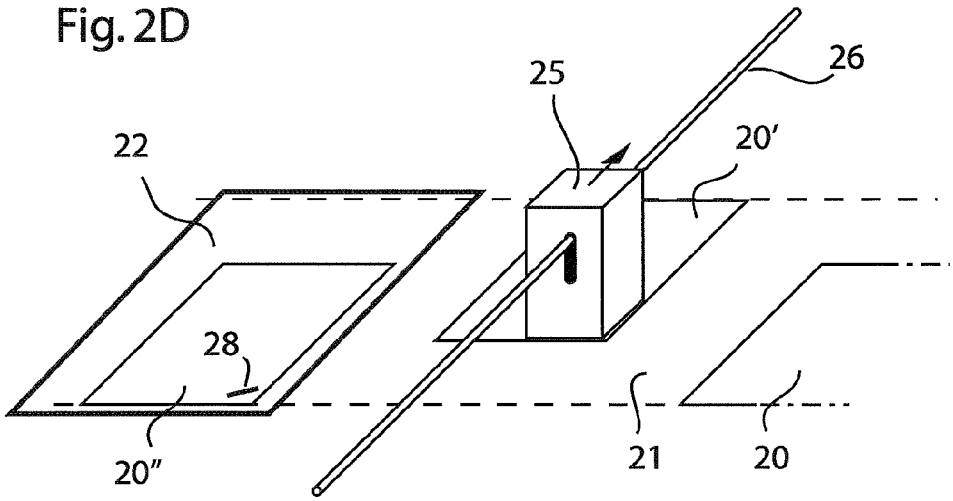

FIG. 2C illustrates the configuration in which the stapling unit 25 is controlled to perform the stapling operation on stack 20'. During the stapling operation the stapling unit 25 engages with the stack 20' to process stack 20' into a processed set of at least one sheet of print media. FIG. 2D illustrates the stapling unit 25 being controlled from its operating position towards a lateral delivery position during or after the post-processing operation while the engagement with stack 20' is maintained. The engagement between stack 20' and stapling unit 25 is a physical friction based engagement resulting from the clamping force between the stapling unit 25, the stack 20' and the anvil (not shown). The lateral delivery position is a predetermined lateral position along the width of the sheet transport path 21 in which the stack of sheets is to be delivered at the delivery position 22. Several lateral delivery positions may be possible along the width of the sheet transport path 21. Alternating between two or more lateral delivery positions results in an easier distinction between stacks 20" or sets of stacks 20". An alternation between two or more lateral delivery positions may also result in an increased stacking capacity at the delivery location 22, and/or a higher quality of the stack alignment, as stacks formed from stapled sets tend to bias at the stapling position due to the increased local height of the staple itself.

Figure 2E:
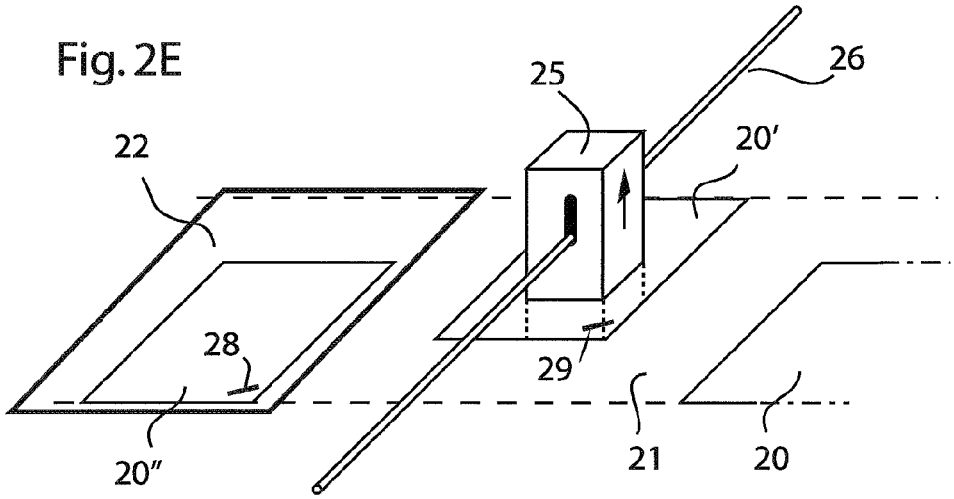
Figure 2F:
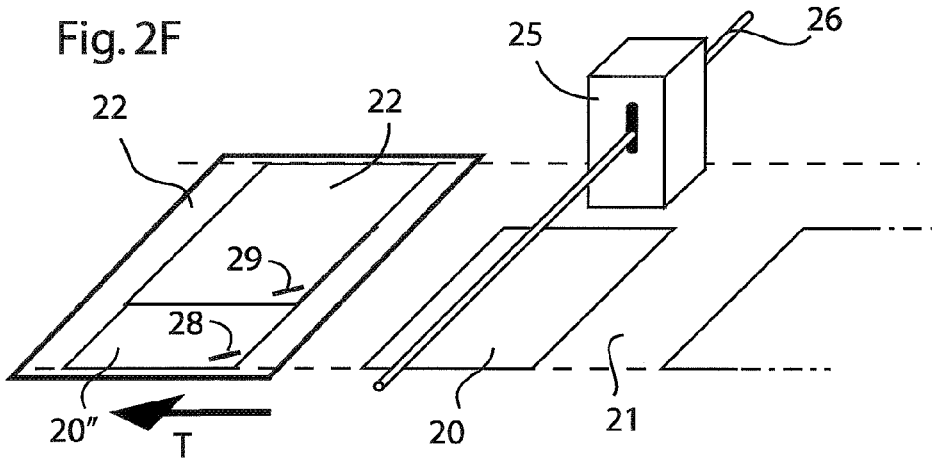

FIG. 2E illustrates the stapling unit controlled to disengage the stapled stack 20' now comprising a staple 29 at the left top corner. The stapled stack 20' is now located at the post-processing location but the stack 20' is moved from its lateral processing location to its required lateral delivery position. The post-processed and laterally offset stack 20' may now be transported towards the delivery location 22 where it is placed on top of the preceding stack as illustrated in FIG. 2F. It will be clear for the skilled person that post-processing and transporting of the stack 20' to the delivery location 22 along the sheet transport path 21 may, in an alternative embodiment, be executed at the same time. In such embodiment, the post-processing unit is moveable in both lateral as well as transport direction T. The operation as illustrated in FIGS. 2A-2F may now be repeated, if required. It will be clear for the skilled person that the subsequent stacks may be offset in both lateral as well as transport direction, if required.

Figure 3A:
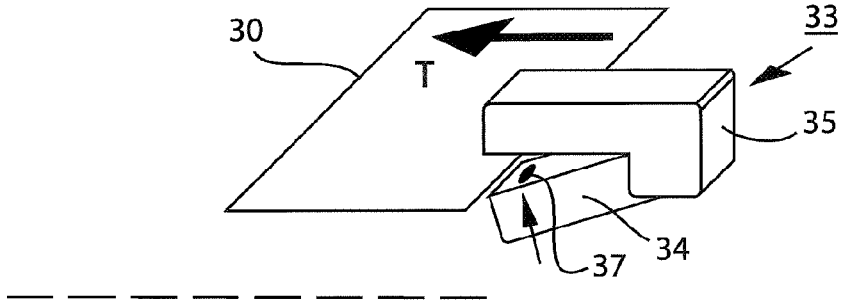
FIGS. 3A-3D are schematic views illustrating the operation as illustrated in 2A-2F, wherein the post-processing unit is a laterally moveable stapling unit 33 along a guide rail (not shown)
Figure 3B:
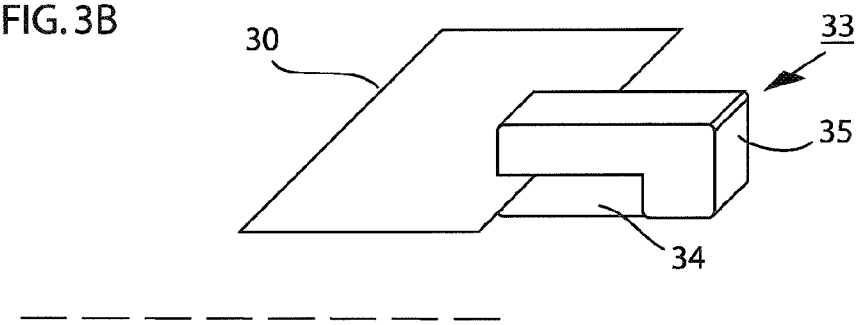
Figure 3C:
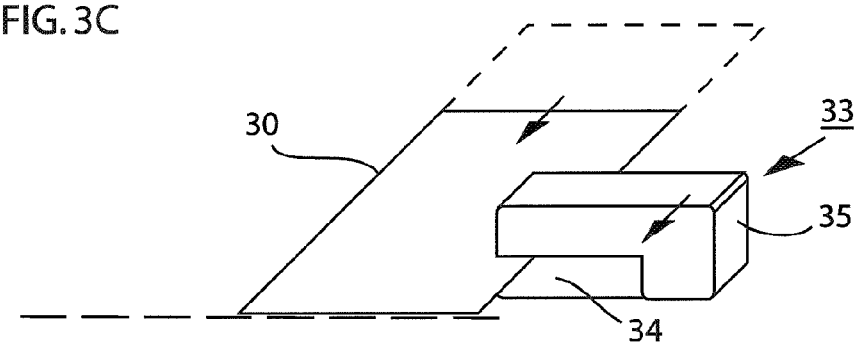
Figure 3D:
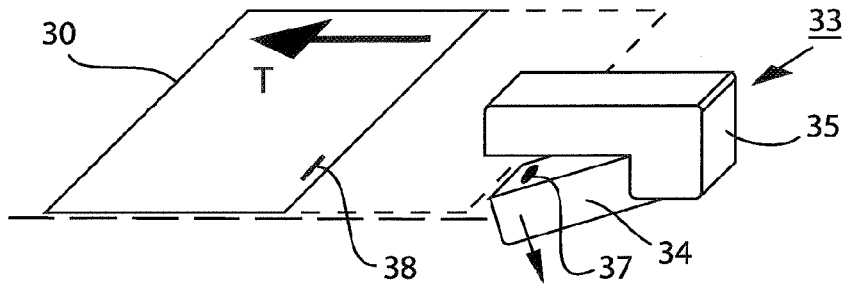

FIGS. 3A-3D illustrate the operation as illustrated in 2A-2F, wherein the post-processing unit is a laterally moveable stapling unit 33 along a guide rail (not shown). The stapling unit comprises a stapling base 35 and a rotatable anvil 36, controllably moveable towards the stapling base 35. The stapling unit comprises engagement cushions 37 on both the stapling base 35 and the moveable anvil 34. The engagement cushions 37 are configured to impose a frictional force on the stack 30 during the closed state of the stapling unit 33 as illustrated in FIGS. 3B and 3C. The engagement cushions 37 do not disturb the (post-processed) stack 30 in the open state of the stapling unit 33 as illustrated in FIGS. 3A and 3D. The stapling unit 33 operates on the stack 30 at the lateral post-processing position as illustrated in FIGS. 3A and 3B, and is subsequently moved to a lateral delivery position by engagement of the stapling unit 33 as illustrated in FIGS. 3C and 3D from which the stack 30 is transported along the sheet transport path towards a delivery location (not shown) in transport direction T.

Figure 4A:
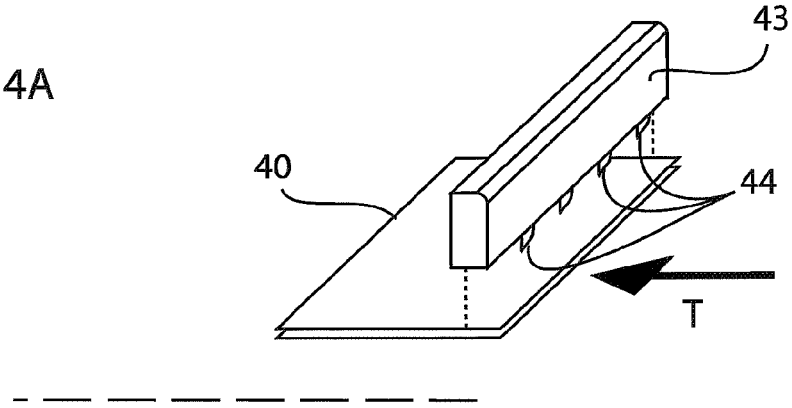
FIGS. 4A-4D are schematic views illustrating an example of the operation as illustrated in 2A-2F, wherein the post-processing unit is a laterally moveable punch unit 43 comprising four punch dyes 44 along a guide rail (not shown).
Figure 4B:
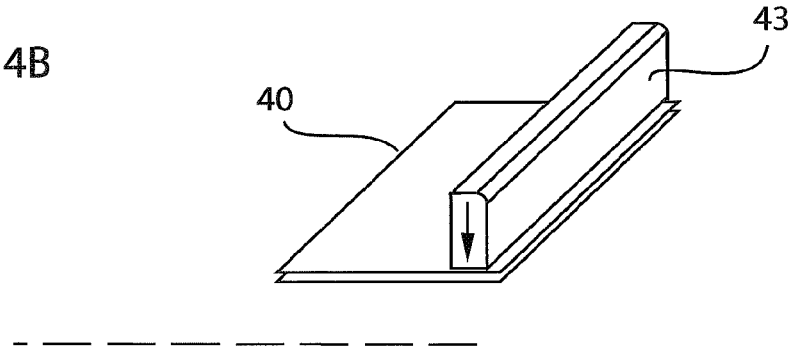
Figure 4C:
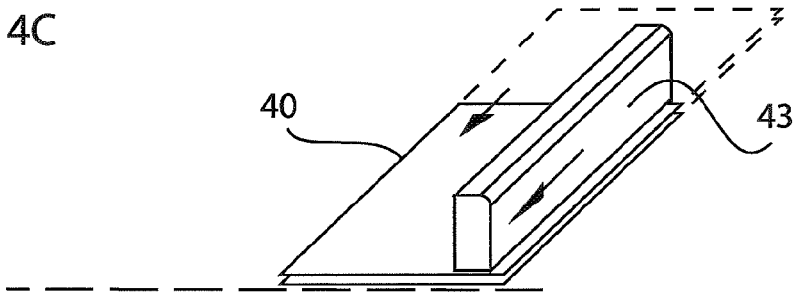
Figure 4D:
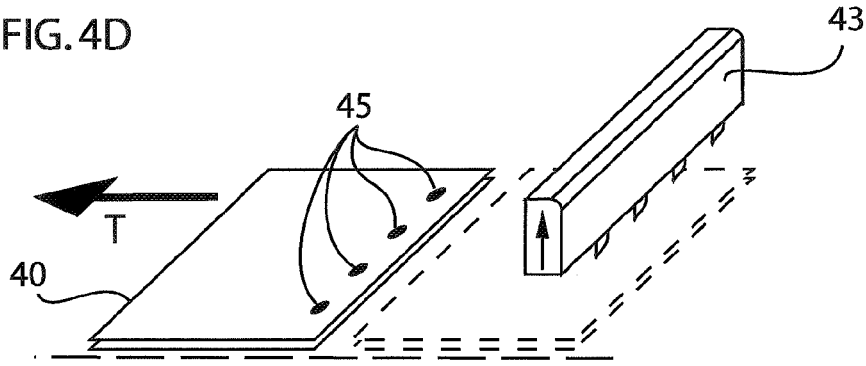

FIGS. 4A-4D schematically show an example of the operation as illustrated in 2A-2F, wherein the post-processing unit is a laterally moveable punch unit 43 comprising four punch dyes 44 along a guide rail (not shown). The punch unit 43 operates on the stack 40 at the lateral post-processing position as illustrated in FIGS. 4A and 4B and is subsequently moved to lateral delivery position by engagement of the punch unit 43 as illustrated in FIGS. 4C and 4D from which the stack 40 is transported along sheet transport path towards a delivery location (not shown) in transport direction T. FIG. 4D illustrates the post-processed stack 40 comprising punch holes 45 where the stack 40 is at its required lateral delivery position. It will be clear that the form and number of individual punch dyes may vary in number, form and configuration. In an alternative embodiment, the punch unit 43 comprises engagement cushions as described in relation to FIGS. 3A-3D.

Detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure. In particular, features presented and described in separate dependent claims and/or embodiments may be applied in combination and any combination of such claims and/or embodiments are herewith disclosed.

The terms and phrases used herein are not intended to be limiting; but rather, to provide an understandable description of the invention. The terms "a" or "an", as used herein, are defined as one or more than one. The term plurality, as used herein, is defined as two or more than two. The term another, as used herein, is defined as at least a second or more. The terms including and/or having, as used herein, are defined as comprising (i.e., open language). The term coupled, as used herein, is defined as connected, although not necessarily directly.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A method for processing a set of at least one sheet in a sheet processing apparatus, said method comprising the steps of:

determining a lateral delivery position for the set of at least one sheet;

moving a post-processing module with respect to the set of at least one sheet to an operating position such that the post-processing module is able to operate at a predetermined position on the set of at least one sheet; and operating the post-processing module to subsequently:

engage the set of at least one sheet to process the set of at least one sheet into a processed set of at least one sheet;

move the post-processing module from the operating position to the lateral delivery position in coupling engagement with the processed set of at least one sheet, such that the processed set of at least one sheet is moved to the lateral delivery position; and disengage the post-processing module to deliver the processed set of at least one sheet at the lateral delivery position, wherein the coupling engagement during the lateral movement of the post-processing module and the processed set of at least one sheet comprises an at least partially protruding engagement.

2. The method according to claim 1, wherein the coupling engagement comprises a clamping engagement.

3. The method according to claim 1, further comprising the step of stapling the set of at least one sheet.

4. The method according to claim 1, further comprising the step of applying at least one hole through the set of at least one sheet.

5. The method according to claim 1, further comprising the step of binding the set of at least one sheet.

6. A sheet processing apparatus for processing a set of at least one sheet, the sheet processing apparatus, comprising:

a laterally moveable post-processing module moveable from a predetermined operating position to a predetermined lateral delivery position; and a control unit for controlling the post-processing module, wherein the control unit is configured to operate the post-processing module such that a lateral delivery position for the set of at least one sheet is determined, and the post-processing module is configured to be movable with respect to the set of at least one sheet to the operating position, and operable to subsequently:

engage the set of at least one sheet to process the set of at least one sheet into a processed set of at least one sheet;

move the post-processing module from the operating position to the delivery position in coupling engagement with the processed set of at least one sheet, such that the processed set of at least one sheet is moved to the lateral delivery position; and disengage the post-processing module to deliver the processed set of at least one sheet at the lateral delivery position, wherein the post-processing module is configured to engage with the set of at least one sheet by at least partially protruding the set of at least one sheet during the lateral movement from the operation position to the delivery position.

7. The sheet processing apparatus according to claim 6, wherein the post-processing module is configured to engage with the set of at least one sheet by clamping the set of at least one sheet.

8. The sheet processing apparatus according to claim 6, wherein the post-processing module comprises a stapler unit configured to staple the set of at least one sheet.

9. The sheet processing apparatus according to claim 8, wherein the stapler unit comprises a clamping device configured to clamp the set of at least one sheet.

10. The sheet processing apparatus according to claim 6, wherein the post-processing module comprises a device configured to apply at least one hole through the set of at least one sheet.

11. The sheet processing apparatus according to claim 6, wherein the post-processing module comprises a binder configured to bind the set of at least one sheet.

12. A printing system comprising the sheet processing apparatus according to claim 6.

* * * * *